US011167830B2

(12) United States Patent
Ito

(10) Patent No.: US 11,167,830 B2
(45) Date of Patent: Nov. 9, 2021

(54) OUTBOARD MOTOR

(71) Applicant: SUZUKI MOTOR CORPORATION, Hamamatsu (JP)

(72) Inventor: Jun Ito, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 16/911,711

(22) Filed: Jun. 25, 2020

(65) Prior Publication Data

US 2021/0001970 A1 Jan. 7, 2021

(30) Foreign Application Priority Data

Jul. 1, 2019 (JP) ..... JP2019-122793

(51) Int. Cl.
*B63H 20/32* (2006.01)
*B63H 20/24* (2006.01)

(52) U.S. Cl.
CPC ..... *B63H 20/32* (2013.01)

(58) Field of Classification Search
CPC ..... B63H 20/32; B63H 20/24
USPC ..... 440/88 M
See application file for complete search history.

(56) References Cited

U.S. PATENT DOCUMENTS 3,240,181 A * 3/1966 Chandler ..... B63H 20/285 440/78
3,310,021 A * 3/1967 Shimanckas ..... B63H 20/245 440/86
3,495,280 A * 2/1970 Galbiati ..... E03C 1/20 4/679
5,700,172 A * 12/1997 Ousley, II ..... B63H 21/10 440/88 C
6,009,823 A * 1/2000 Gross ..... B63B 13/02 114/198
2003/0040231 A1 2/2003 Matsuda et al.
2015/0013486 A1* 1/2015 Kubo ..... B63H 20/14 74/339

FOREIGN PATENT DOCUMENTS

JP S59230887 A 12/1984
JP S61184198 A 8/1986
JP 2003063497 A 3/2003

* cited by examiner

*Primary Examiner* — Stephen P Avila
(74) *Attorney, Agent, or Firm* — Holtz, Holtz & Volek PC

(57) ABSTRACT

An outboard motor includes an outboard-motor main-body, an anti-ventilation plate, and a foreign-matter collection apparatus. The anti-ventilation plate is provided on the outboard-motor main-body. The foreign-matter collection apparatus is provided above the anti-ventilation plate and outside the outboard-motor main-body and located at a height such that a water intake is submerged under water when a ship to which the outboard-motor main-body has been attached is in a pre-planing state.

11 Claims, 10 Drawing Sheets

OUTBOARD MOTOR

CROSS-REFERENCE TO RELATED APPLICATION

This application is based upon and claims the benefit of priority of the prior Japanese Patent Application No. 2019-122793, filed on Jul. 1, 2019, the entire contents of which are incorporated herein by reference.

BACKGROUND OF THE INVENTION

Field of the Invention

The present invention relates to an outboard motor.

Description of the Related Art

Garbage-caused pollution of the sea, lakes, rivers, and the like has been serious problems of environmental destruction. Especially in recent years, microplastics have been focused on. Microplastics consist of plastic particles having a size of, for example, 5 mm or less.

A technique of collecting floating matters in a screen bucket by using a pump installed in a hull has conventionally been proposed (see, for example, Japanese Laid-open Patent Publication No. 59-230887).

An outboard motor includes a strainer disposed at an inlet for cooling water for cooling devices (see, for example, Japanese Laid-open Patent Publication No. 61-184198), and an outboard motor includes a filter disposed in a water channel for cooling water (see, for example, Japanese Laid-open Patent Publication No. 2003-63497).

SUMMARY OF THE INVENTION

Problems to be Solved by the Invention

In the meantime, the above-described microplastics, among other things, have a high impact on aquatic biota, and thus aggressive measures for collecting microplastics have been demanded. However, smaller garbage in the sea, lake, river, or the like are, as a general rule, more difficult to collect. Outboard motors that collect foreign matter in an inlet or water channel for cooling water, as described above, are such that the cooling water cools power sources and is then discharged without minute garbage (e.g., a size of 1 mm or less) being collected. Attempting to collect minute garbage such as microplastics in a passage for cooling water could worsen the performance of taking in the cooling water if clogging occurs or could cause travel resistance worsening the traveling performance. If foreign matter is caught in a hull, workability, such as in removing the caught foreign matter, will be bad.

Accordingly, a foreign-matter collection apparatus for collecting foreign matter could be disposed below an outboard motor. However, the disposing of the foreign-matter collection apparatus would tend to increase travel resistance. Thus, predetermined power performances could not be achieved especially when high-speed traveling is performed (planing state), and this would easily lead to a reduction in commercial value. In the current era in which human beings, concerted with the sea, lake, river, and the like, need to raise the awareness of environmental improvement or awareness of coping with environmental problems, however, such consciousness-raising needs to be widely spread even if the amount of collection of foreign matter such as microplastics in one operation is small.

The present invention was created in view of such facts, and an object thereof is to provide an outboard motor capable of collecting foreign matter while limiting an increase in travel resistance that could occur when high-speed traveling is performed.

Means for Solving Problems

An outboard motor of the present invention includes an outboard-motor main-body, an anti-ventilation plate provided on the outboard-motor main-body, and a foreign-matter collection apparatus provided above the anti-ventilation plate and outside the outboard-motor main-body and located at a height such that a water intake is submerged under water when a ship to which the outboard-motor main-body has been attached is in a pre-planing state.

Effect of the Invention

The invention allows foreign matter to be collected while limiting an increase in travel resistance that could occur when high-speed traveling is performed.

DETAILED DESCRIPTION OF THE PREFERRED EMBODIMENT

Figure 1:
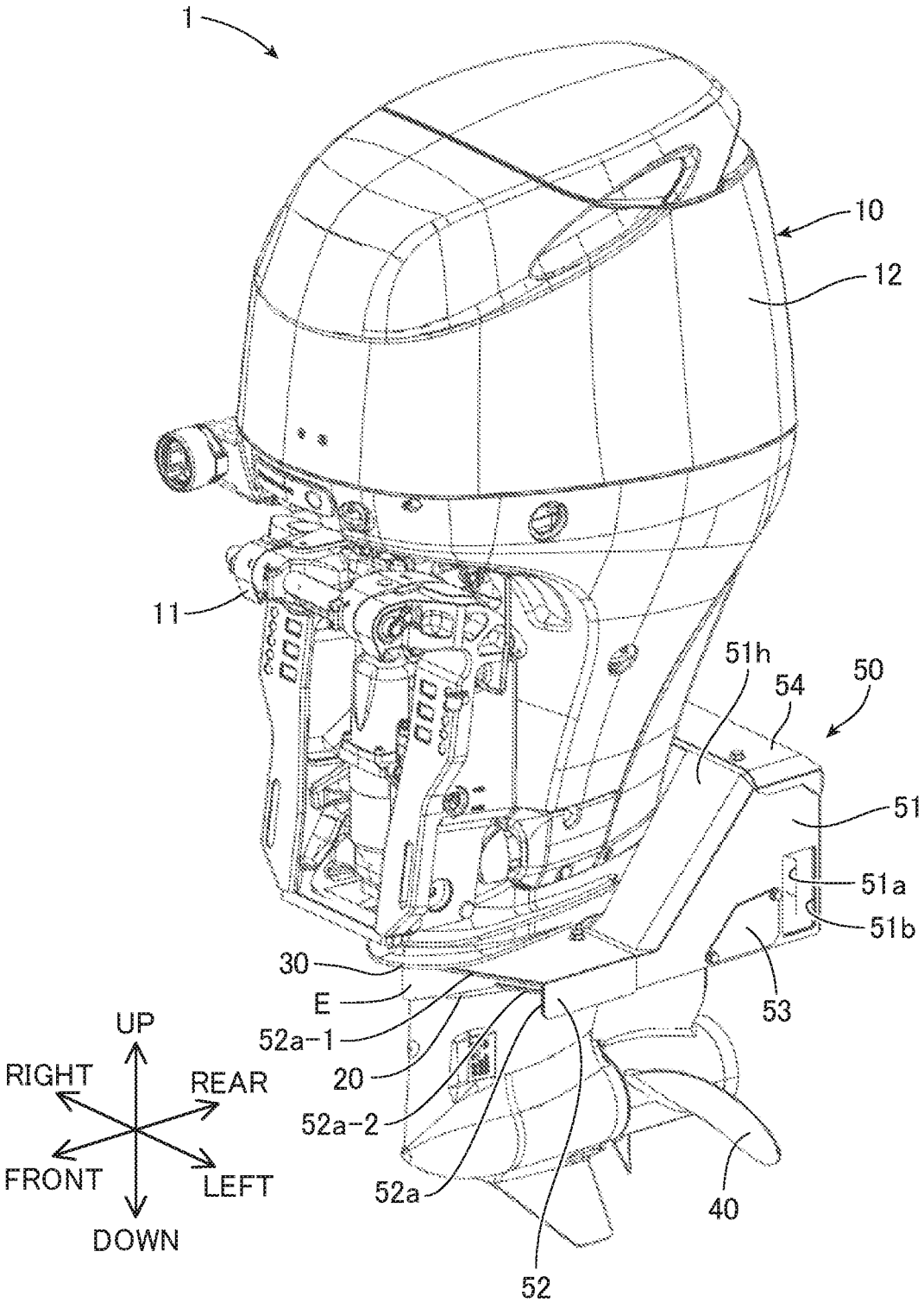
FIG. 1 is a perspective view illustrating an outboard motor in accordance with a first embodiment.

The following describes outboard motors in accordance with first and second embodiments of the present invention by referring to the drawings.

First Embodiment

Figure 2:
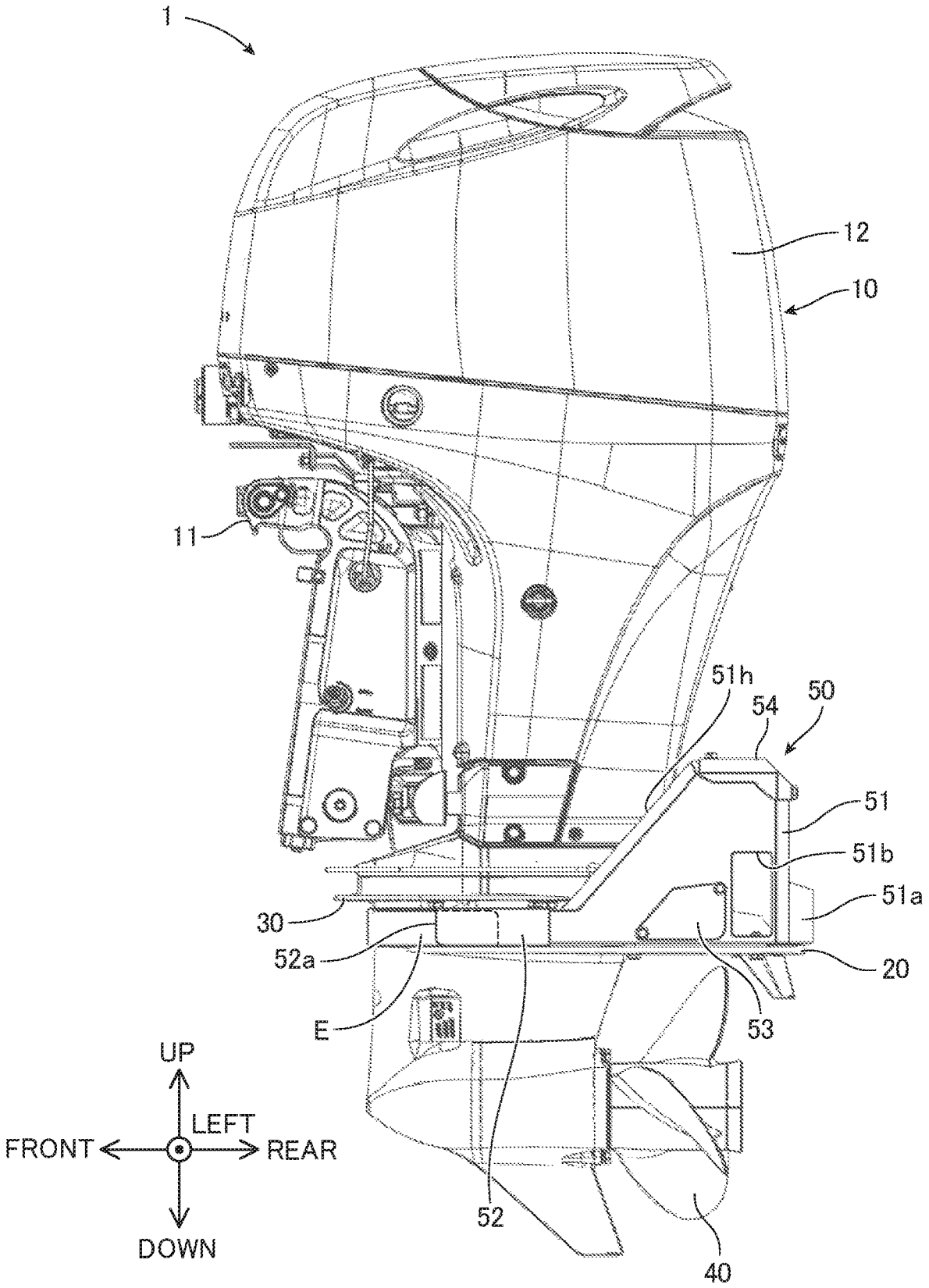
FIG. 2 is a left side view illustrating an outboard motor in accordance with a first embodiment.

FIGS. 1 and 2 are a perspective view and a left side view illustrating an outboard motor 1 in accordance with the first embodiment. The outboard motor 1 depicted in FIGS. 1 and 2 is a ship propulsion apparatus attached to a stern constituting a rear portion of a ship (not illustrated). The orientation of the outboard motor 1 can be changed with reference to the hull. In FIGS. 1 and 2 and FIGS. 3-10, which are described hereinafter, arrows indicate a front-rear direction, up-down direction, and left-right direction orthogonal to each other with the rotational axis (propeller shaft) of a propeller 40 of the outboard motor 1 defined as the front-rear direction. The hull is on the front side, and the outboard motor 1 is on the rear side. The right side is the side to the right of an imaginary line from the outboard motor 1 to the hull, and the left side is the side to the left of this imaginary line.

As depicted in FIGS. 1 and 2, the outboard motor 1 includes an outboard-motor main-body 10, an anti-ventilation plate 20, an anti-splash plate 30, a propeller 40, and a foreign-matter collection apparatus 50.

The outboard-motor main-body 10 includes an attachment apparatus 11 for attaching the outboard motor 1 to the hull in a detachable manner, an engine cover 12 covering an engine for driving the propeller 40 in a sealed state, and the like. The propeller 40 is disposed at a lower rear portion of the outboard-motor main-body 10. The outboard-motor main-body 10 is also provided with the anti-ventilation plate 20, which is located above the propeller 40 and protruding outward. In addition, the outboard-motor main-body 10 is provided with the anti-splash plate 30, which is located above the anti-ventilation plate 20 and protruding outward. Although not illustrated, the outboard-motor main-body 10 accommodates the engine, a crankshaft for transferring power from the engine to the propeller 40, a propeller shaft disposed orthogonal to the crankshaft, and the like.

For example, the anti-ventilation plate 20 may protrude outward in a horizontal direction (parallel to the front-rear and left-right directions) from an area extending over left and right side portions and a rear portion of the outboard-motor main-body 10. The anti-ventilation plate 20 is provided above the propeller 40. The anti-ventilation plate 20 reduces racing of the propeller 40 that could occur due to air being taken in through the water surface in accordance with rotation of the propeller 40. The anti-ventilation plate 20 may also be referred to as a ventilation plate, an anticavitation plate, or a cavitation plate.

The anti-splash plate 30 is located above the anti-ventilation plate 20 and may protrude outward in the horizontal direction from, for example, an area extending over a front portion and left and right side portions of the outboard-motor main-body 10. The anti-splash plate 30 reduces sprays of water. The anti-splash plate 30 may also be referred to as a splash plate.

The propeller 40 rotates in accordance with a driving force of the engine being transferred to the propeller shaft via the crankshaft, as described above.

The foreign-matter collection apparatus 50 is provided above the anti-ventilation plate 20 and outside the outboard-motor main-body 10 and located at a height such that a water intake 52*a* is submerged under water when a ship to which the outboard-motor main-body 10 has been attached is in a pre-planing state (non-planing state). For example, the foreign-matter collection apparatus 50 may be located above the anti-ventilation plate 20 and affixed to a rear portion of the outboard-motor main-body 10 by, for example, a screw in a detachable manner.

Figure 3:
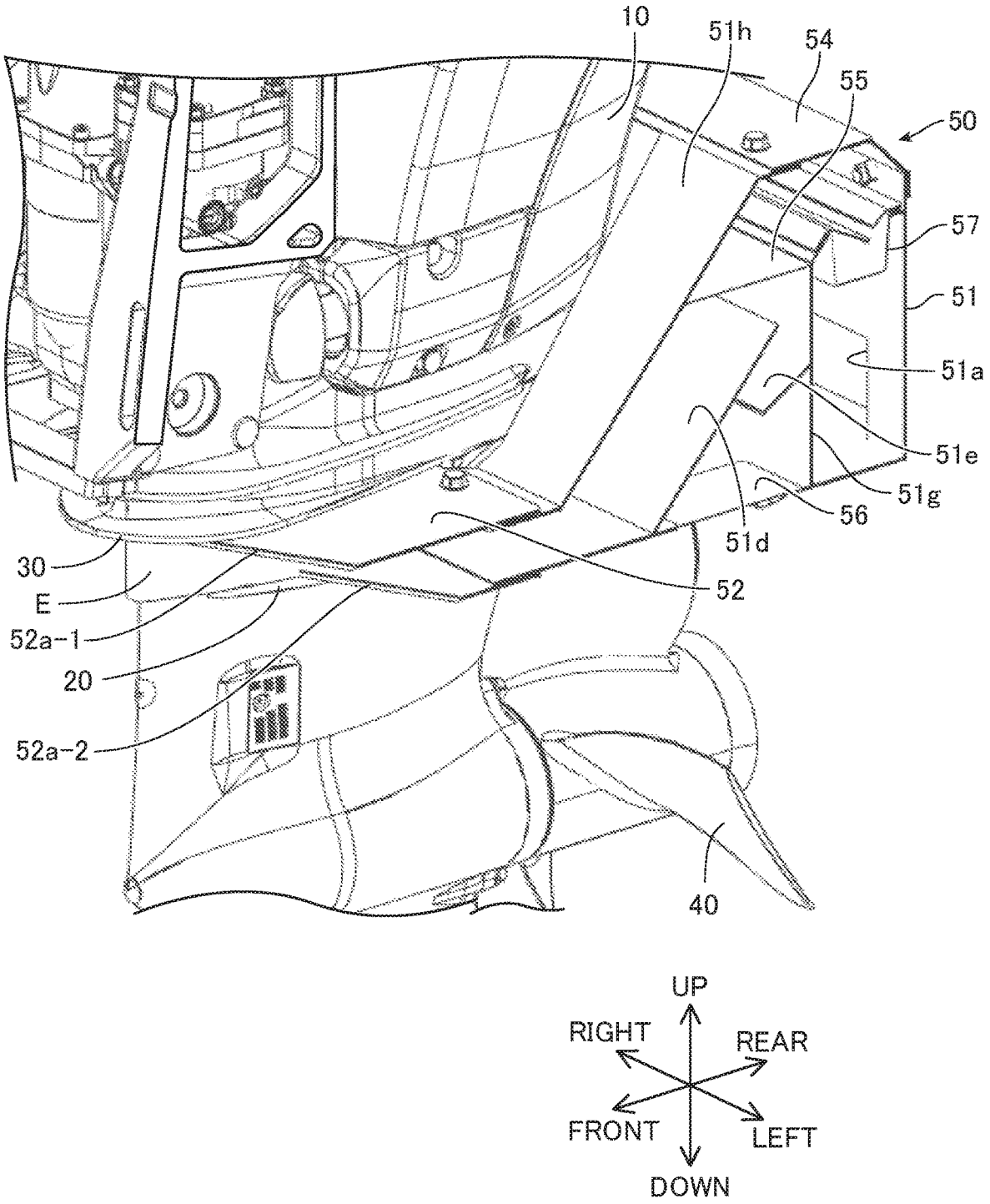
FIG. 3 is a cross-sectional view illustrating the internal configuration of a foreign-matter collection apparatus in a first embodiment.
Figure 4:
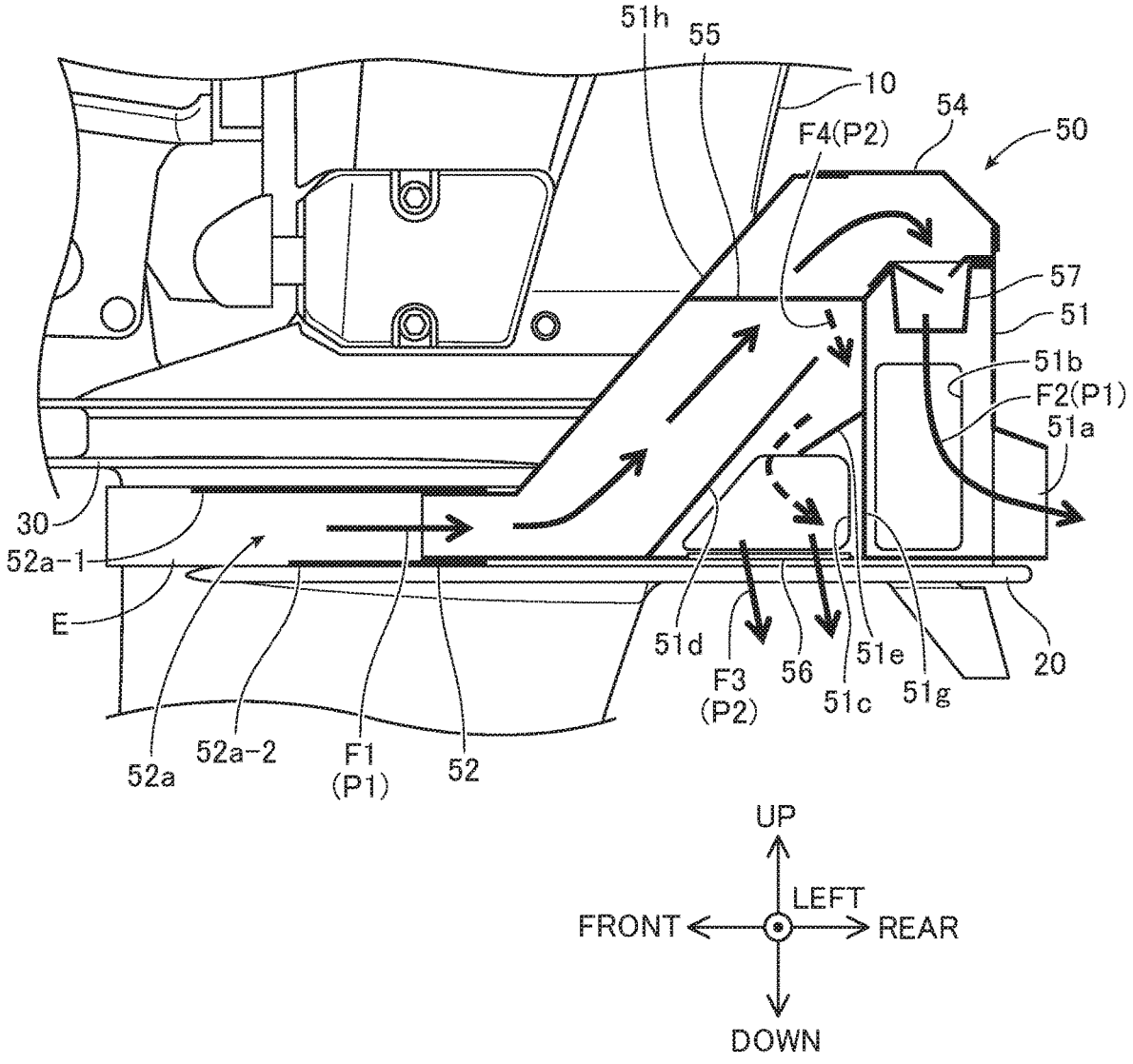
FIG. 4 is a cross-sectional view for illustrating flows of water and foreign matter within a foreign-matter collection apparatus in a first embodiment.
Figure 5:
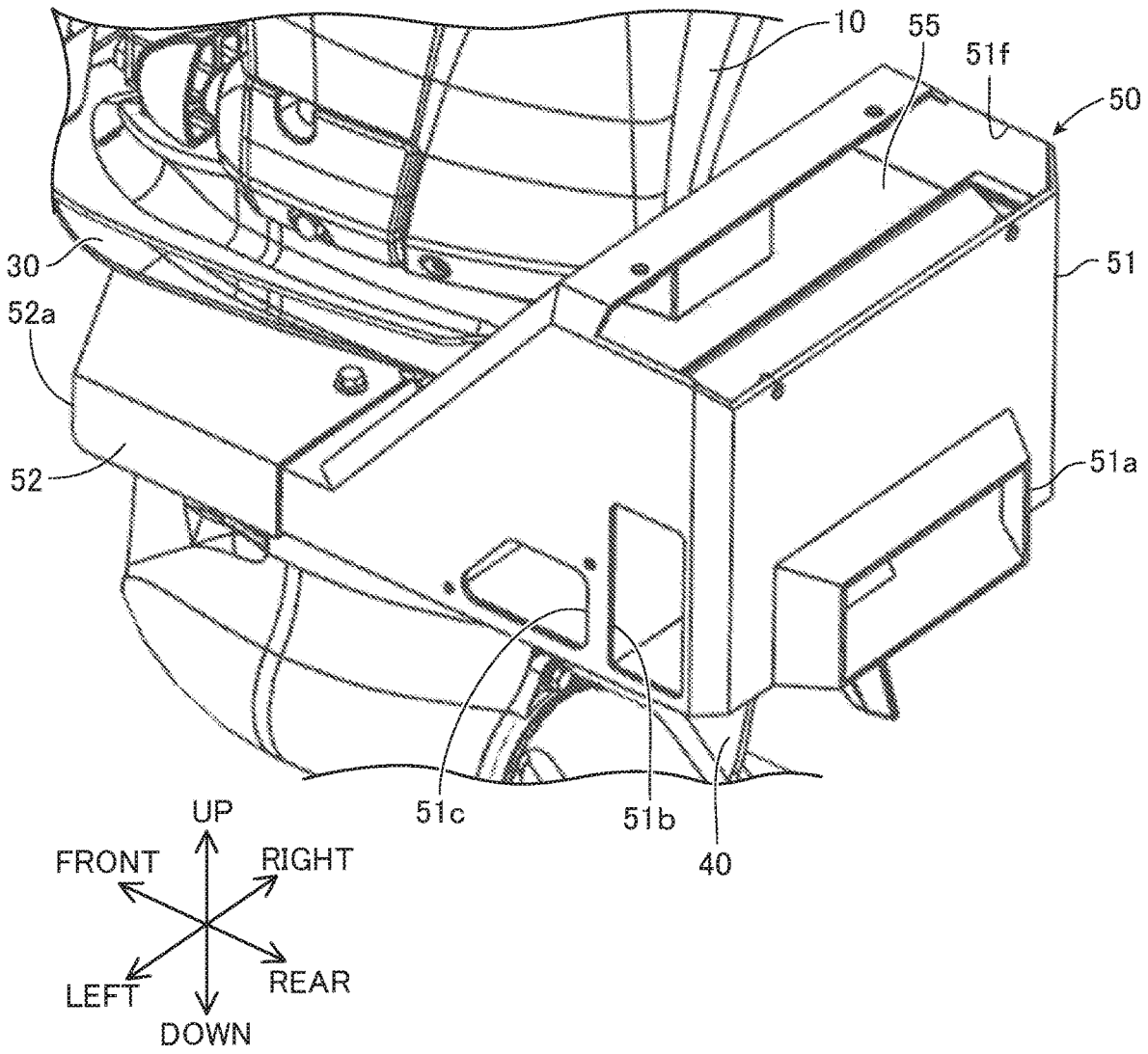
FIG. 5 is a perspective view illustrating a foreign-matter collection apparatus (with first and second lids removed) in a first embodiment.
Figure 6:
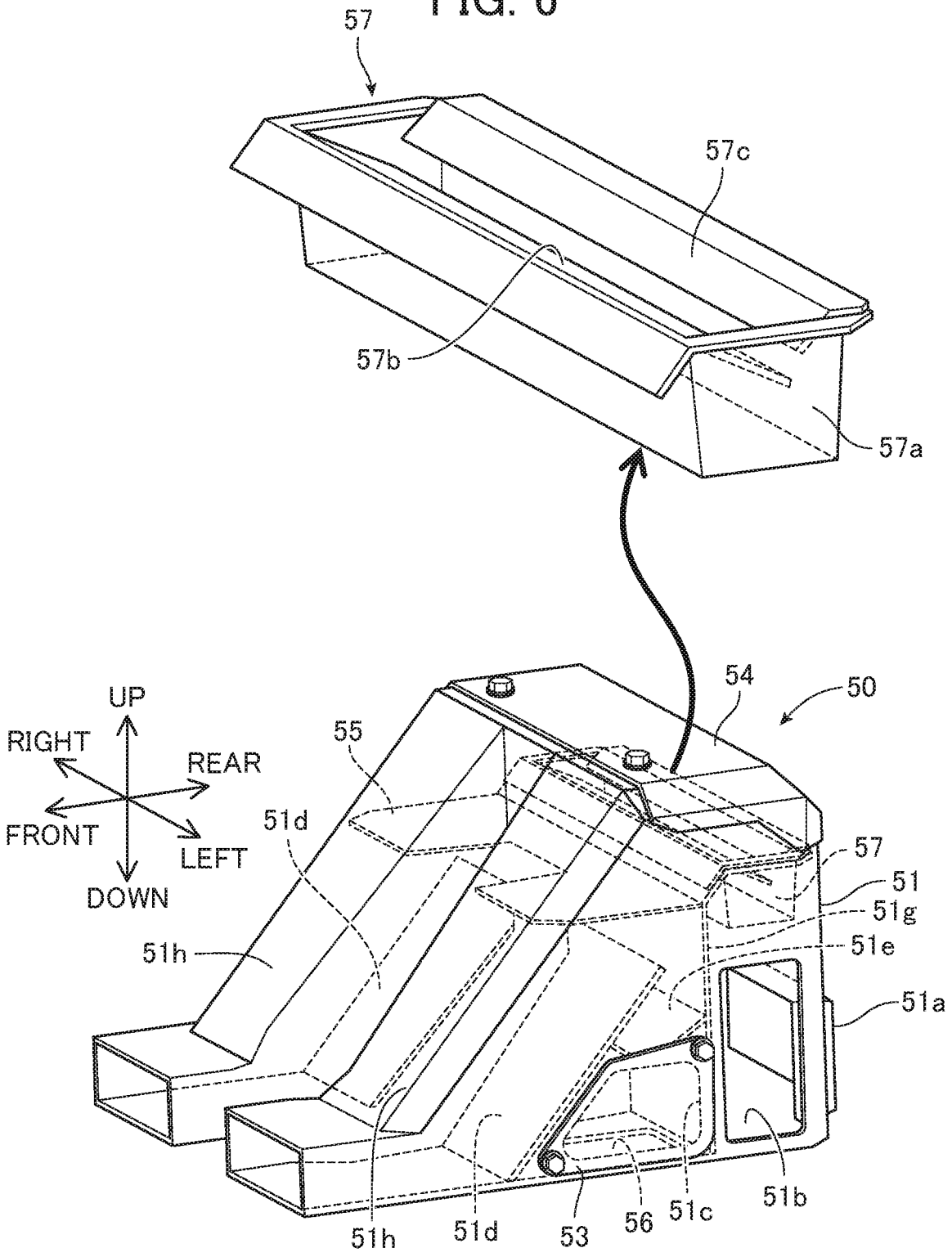
FIG. 6 is a perspective view illustrating the internal structure of a foreign-matter collection apparatus (with a water-intake cover removed) in a first embodiment and an enlarged perspective view illustrating a filter unit.
Figure 7:
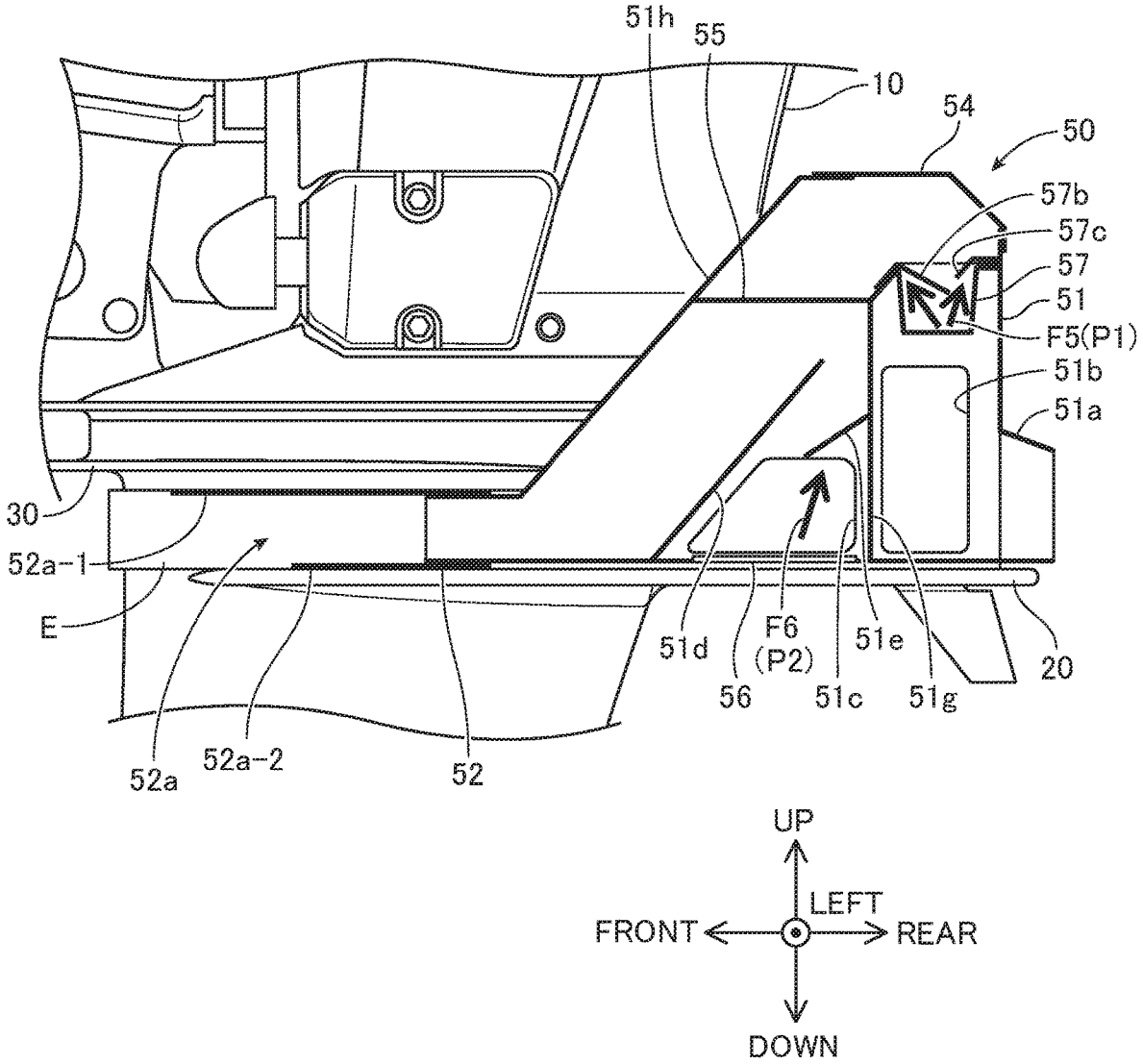
FIG. 7 is a cross-sectional view for illustrating backflows within a foreign-matter collection apparatus in a first embodiment.
Figure 8:
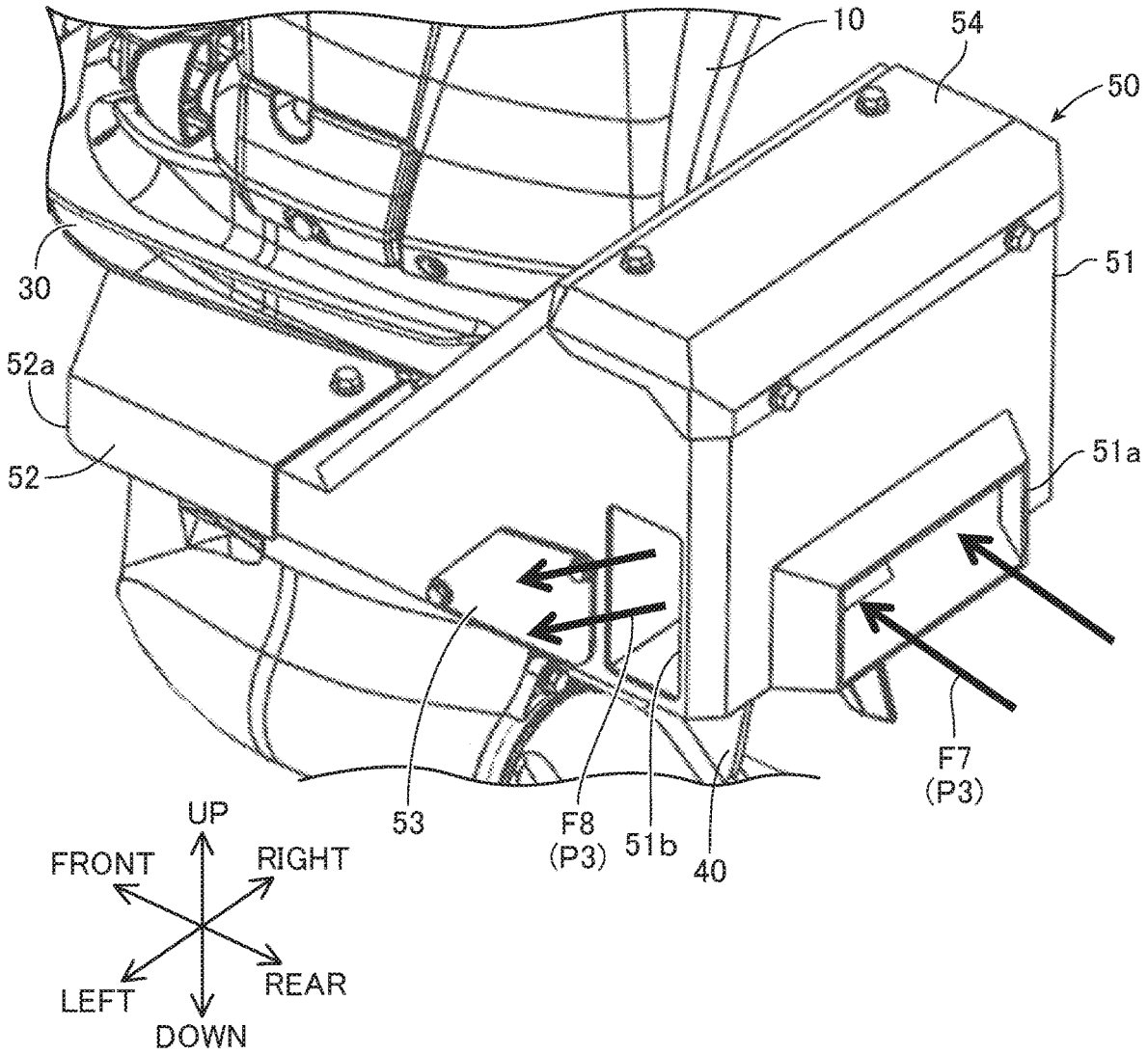
FIG. 8 is a perspective view for illustrating backflows within a foreign-matter collection apparatus in a first embodiment.

The following describes details of the configuration of the foreign-matter collection apparatus 50 in the first embodiment by using FIGS. 3-8 with reference to FIGS. 1 and 2. FIG. 3 is a cross-sectional view illustrating the internal configuration of the foreign-matter collection apparatus 50. FIG. 4 is a cross-sectional view for illustrating water flows F1-F3 and a foreign-matter flow F4 within the foreign-matter collection apparatus 50. FIG. 5 is a perspective view illustrating the foreign-matter collection apparatus 50 (with a first lid 53 and a second lid 54 removed) in a first embodiment. FIG. 6 is a perspective view illustrating the internal structure of the foreign-matter collection apparatus 50 (with a water-intake cover 52 removed) and an enlarged perspective view illustrating a filter unit 57. FIG. 7 is a cross-sectional view for illustrating backflows F5 and F6 within the foreign-matter collection apparatus 50. FIG. 8 is a perspective view for illustrating backflows F7 and F8 within the foreign-matter collection apparatus 50.

As depicted in FIGS. 3-8, the foreign-matter collection apparatus 50 includes a body case 51, water-intake covers 52, first lids 53, a second lid 54, first filters 55, bypass filters 56, and a filter unit 57. For example, a pair of water-intake covers 52, a pair of first lids 53, a pair of first filters 55, and a pair of bypass filters 56 may be disposed such that each pair has left-right symmetry with respect to the outboard-motor main-body 10. These pairs of components will be described herein by referring mainly to examples for the components located on the left side of the outboard-motor main-body 10.

The body case 51 includes a front section branching into left and right portions sandwiching the outboard-motor main-body 10 in the left-right direction (see FIGS. 1 and 6). As depicted in FIGS. 1, 5, and 8, the water-intake covers 52 are each affixed to each of the leading ends of the two branches of the body case 51 by, for example, a screw. For example, the water-intake cover 52 may assume a rectangular hollow shape (an example of a hollow shape) open in the front-rear direction and include a front portion functioning as the water intake 52*a*. The water intake 52*a* is located below the anti-splash plate 30.

As depicted in FIGS. 1 and 3, the water intake 52*a* of the water-intake cover 52 located to the left of the outboard-motor main-body 10 includes an upper edge 52*a*-1 provided with an inclined portion extending rightward to be positioned forward of the left side face. A lower edge 52*a*-2 is provided rearward of the upper edge 52*a*-1 and includes an inclined portion extending forward right. Accordingly, the upper edge 52*a*-1 of the water intake 52*a* is located forward of the lower edge 52*a*-2 when seen in the left side view depicted in FIG. 4.

As depicted in FIG. 2, an elastic body E, e.g., rubber, is disposed between the foreign-matter collection apparatus 50 (e.g., the right and left water-intake covers 52) and the outboard-motor main-body 10. The elastic body E is located between the anti-splash plate 30 and the anti-ventilation plate 20 and provided on, for example, an area extending over a front portion and left and right side portions of the outboard-motor main-body 10. The anti-ventilation plate 20 and the anti-splash plate 30 may be considered to be portions of the outboard-motor main-body 10, and thus the elastic body may be disposed between the foreign-matter collection apparatus 50 and the anti-ventilation plate 20 or the anti-splash plate 30.

As depicted in FIGS. 1, 4, and 6, an external guide plate 51*h* inclined downward toward the front is provided on an upper portion of each of the two branches of the body case 51. A lower portion of the body case 51 has, for example, a constant height over the entirety thereof. Accordingly, the front portion inside the body case 51 has a less height than the rear portion inside the body case 51.

As depicted in FIGS. 3, 4, and 6, a pair of left and right inner guide plates 51*d* are provided inside the body case 51 so as to be positioned below the pair of left and right external guide plates 51*h*. The internal guide plates 51*d* are disposed parallel to the external guide plates 51*h*, i.e., inclined downward toward the front.

As depicted in FIG. 5, a water outlet 51*a* extending rearward is provided on a lower portion of the rear edge of the body case 51. As depicted in FIGS. 4 and 6, waters (water flows F1) taken in through the pair of left and right water-intake covers 52 (water intakes 52*a*) meet after flowing through the first filters 55 and flow through the filter unit 57 (second filter 57*a*) to the water outlet 51*a* (water flow F2). Main passages P1 extending, as described above, from the two water intakes 52*a* through the first filters 55 and the second filter 57*a* are examples of the first passage.

As depicted in FIG. 6, the first filters 55 assume a U shape when seen in a plan view and are provided within the two branches of the body case 51. The filter unit 57 includes a second filter 57*a* assuming a rectangular-solid shape having an opening in the upper surface thereof and barriers 57*b* and 57*c* provided on the upper edge of the second filter 57*a* and facing each other in the front-rear direction.

The second filter 57*a* includes finer pores than the first filters 55. Assuming, for example, that microplastics visible to the naked eye are included in objects to be collected, the size of the smallest foreign matter visible to the naked eye is generally said to be at least about 0.1 to 0.2 mm. Thus, the fineness of the pores in the second filter 57*a* may be such that foreign matter with a size of about 0.1 to 0.2 mm can be caught. Microplastics consist of plastic particles having a size of, for example, 5 mm or less. Thus, assuming that the first filters 55 do not catch microplastics but only the second filter 57*a* catches microplastics, the pores in the first filters 55 will have a size such that foreign matter with a size greater than 5 mm can pass therethrough. The second filter 57*a* will have fine pores to capture foreign matter with a size of 5 mm or less.

If the second filter 57*a* (or first filter 55) is clogged, water taken in through the water intake 52*a* (water flow F1) passes below the first filter 55 and is discharged through the bypass filter 56 provided on the bottom surface of the body case 51 (water flow F3), as depicted in FIG. 4. Bypass passages P2 each branched, as described above, from a portion of each of the main passages P1 between the water intake 52*a* and the filter unit 57 are examples of the second passage. Foreign matter captured by the first filter 55 is accommodated in a space above the bypass filter 56 (see the foreign-matter flow F4 indicated by dashed lines). Thus, the bypass filter 56 may include pores that are as fine as (or finer than) those in the first filter 55. The space above the bypass filter 56 is located rearward of the internal guide plate 51*d* and forward of a partition wall 51*g*. The partition wall 51*g* has a thickness direction in the front-rear direction. A portion of the body case 51 at which the bypass filter 56 is provided also functions as a water outlet, as with the water outlet 51*a*.

As depicted in FIGS. 1, 2, and 4-8, a pair of left and right backflow release holes 51*b* are provided in rear portions of the left and right side surfaces of the body case 51. As depicted in FIG. 8, the backflow release hole 51*b* releases a backflow F7 drawn in through the water outlet 51*a* (see backflow F8) when the outboard motor 1 moves rearward. Hence, outflow of foreign matter caught by the first filters 55 and the second filter 57*a* can be reduced. Note that the backflows F7 and F8 travel through a backflow passage P3.

As depicted in FIG. 7, the barriers 57*b* and 57*c* of the filter unit 57 reduce backflows F5 from the water outlet 51*a* through the main passages P1. Hence, outflow of foreign matter caught by the second filter 57*a* can be reduced. Barriers 51*e* provided above the pair of left and right bypass filters 56 reduce backflows F6 from the bypass filters 56 (water outlets) through the bypass passages P2. Hence, outflow of the foreign matter accommodated in the space above the bypass filter 56 can be reduced. Note that the backflow release hole 51*b* and the barriers 51*e*, 57*b*, and 57*c* are examples of the backflow release section.

As depicted in FIGS. 5 and 6, a pair of left and right first foreign-matter removal ports 51*c* located forward of the backflow release holes 51*b* are provided on the left and right side surfaces of the body case 51. The first foreign-matter removal port 51*c* is used to remove the bypass filter 56 or the foreign matter accommodated in the space above the bypass filter 56 (see the foreign-matter flow F4 depicted in FIG. 4). As depicted in FIG. 6, the pair of left and right first foreign-matter removal ports 51*c* are each covered with a first lid 53 affixed to the body case 51 in a detachable manner by, for example, a screw.

As depicted in FIG. 5, a second foreign-matter removal port 51*f* located above the filter unit 57 is provided on an upper rear edge of the body case 51. The second foreign-matter removal port 51*f* is used to remove the foreign matter caught by the second filter 57*a*, together with, for example, the filter unit 57. In addition, the second foreign-matter removal port 51*f* is used to remove the first filter 55. As depicted in FIG. 6, the second foreign-matter removal port 51*f* is covered with a second lid 54 affixed to the body case 51 in a detachable manner by, for example, a screw.

In the first embodiment described so far, the outboard motor 1 includes the outboard-motor main-body 10, the anti-ventilation plate 20, and the foreign-matter collection apparatus 50. The anti-ventilation plate 20 is provided on the outboard-motor main-body 10. The foreign-matter collection apparatus 50 is provided above the anti-ventilation plate 20 and outside the outboard-motor main-body 10 and located at a height such that the water intake is submerged under water when a ship to which the outboard-motor main-body 10 has been attached is in a pre-planing state. Accordingly, the foreign-matter collection apparatus 50 will be exposed above the water surface when the water surface is lowered approximately to the height of the anti-ventilation plate 20 especially during high-speed traveling (planing state). Thus, when high-speed traveling is performed, an increase in travel resistance of water that is associated with the disposing of the foreign-matter collection apparatus 50 can be limited. Accordingly, the first embodiment allows foreign matter to be collected while limiting an increase in travel resistance that could occur when high-speed traveling is performed. In addition, the foreign-matter collection apparatus 50 is disposed outside the outboard-motor main-body 10 and thus can be easily disposed for an existing outboard-motor main-body 10.

In the first embodiment, the foreign-matter collection apparatus 50 includes: the water outlets 51*a*; and the barriers 51*e*, 57*b*, and 57*c* and the backflow release holes 51*b*, i.e., examples of the backflow release section, which reduce outflow of foreign matter by releasing the backflows F5-F8 flowing through the water outlet 51*a* toward the water intake 52*a*. Hence, discharge of foreign matter caught by the first filters 55, the bypass filters 56, and the second filter 57*a* through the water intake 52*a* can be reduced.

In the first embodiment, the foreign-matter collection apparatus 50 includes: the first filters 55; the second filter 57*a* that includes finer pores than the first filters 55; the main passages (examples of the first passage) P1 from the water intakes 52*a* through the first filters 55 and the second filter 57*a*; and the bypass passages (examples of the second passage) P2 each branched from a portion of each of the main passages P1 between the water intake 52*a* and the second filter 57*a*. Thus, travel resistance that could occur if the second filter 57*a* is clogged can be reduced.

In the first embodiment, the foreign-matter collection apparatus 50 further includes: the first foreign-matter removal ports 51*c* for removing foreign matter caught by the first filters 55; and the second foreign-matter removal port 51*f* for removing foreign matter caught by the second filter 57*a*. Thus, relatively large foreign matter can be removed from the first foreign-matter removal ports 51*c*, and relatively small foreign matter can be removed from the second foreign-matter removal port 51*f*, i.e., foreign matter can be easily removed in a sorted manner. Hence, foreign matter can be easily recycled.

In the first embodiments, the lower edge 52*a*-2 of the water intake 52*a* is provided rearward of the upper edge 52*a*-1 of the water intake 52*a* with reference to the outboard motor 1. Thus, sprays of water during traveling can be received into the foreign-matter collection apparatus 50.

In the first embodiment, the outboard motor 1 further includes the anti-splash plate 30 provided on the outboard-motor main-body 10, and the water intakes 52*a* are located below the anti-splash plate 30. Thus, sprays of water guided downward by the anti-splash plate 30 can be received into the foreign-matter collection apparatus 50. Especially when low-speed traveling is performed (non-planing (pre-planing) state), the water intake 52*a* can be easily submerged under water in comparison with aspects in which the water intake 52*a* is disposed above the anti-splash plate 30. Hence, foreign matter can be collected more efficiently.

In the first embodiment, the outboard motor 1 further includes the elastic body E located between the foreign-matter collection apparatus 50 and the outboard-motor main-body 10. Thus, shaking during traveling that is associated with the disposing of the foreign-matter collection apparatus 50 can be reduced. In addition, the likelihood of the outboard-motor main-body 10 having a scratch and ultimately corroding due to the foreign-matter collection apparatus 50 coming into contact with the outboard-motor main-body 10 can be reduced.

Second Embodiment

Figure 9:
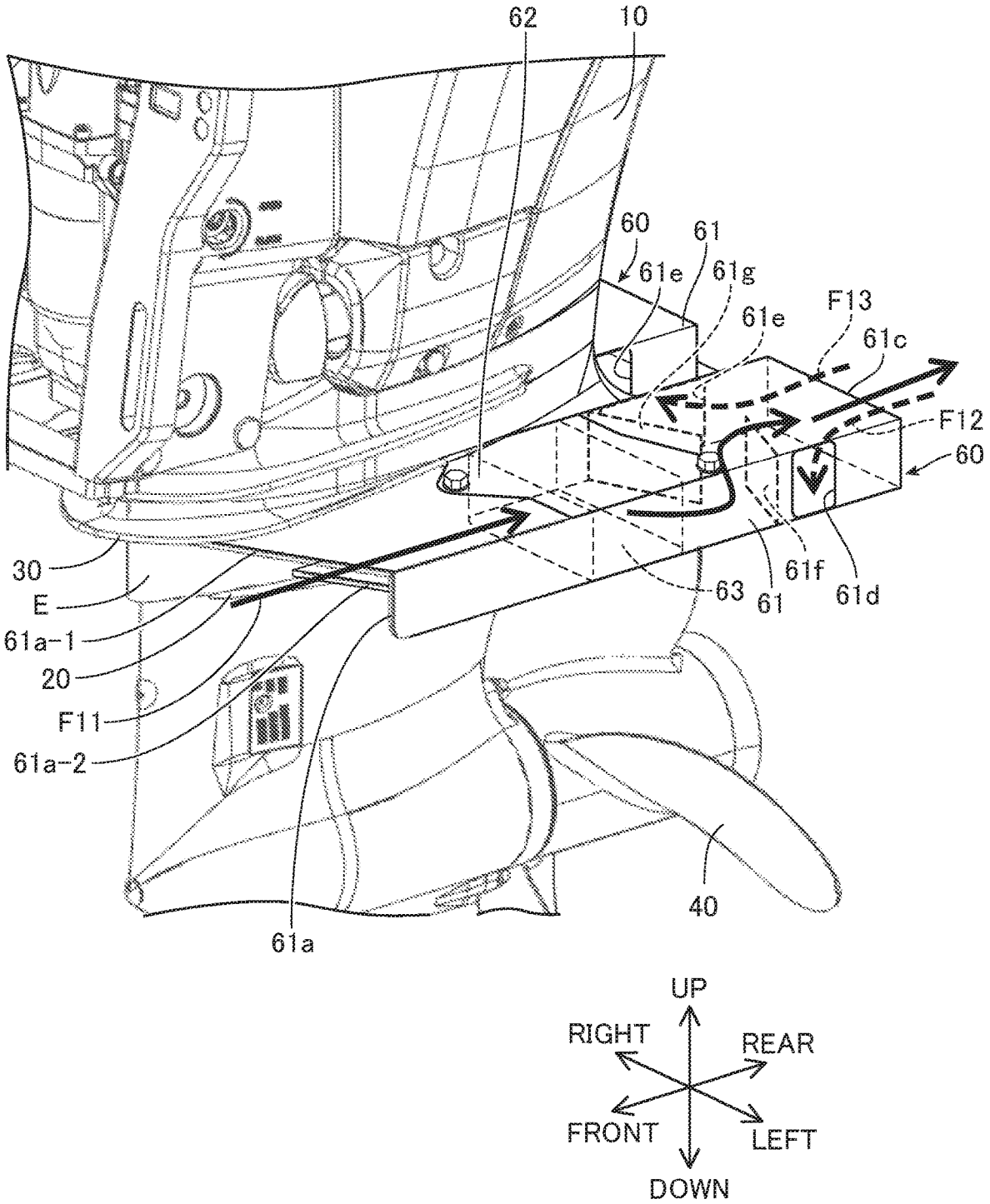
FIG. 9 is a perspective view illustrating the internal configuration of a foreign-matter collection apparatus in a second embodiment.

FIG. 9 is a perspective view illustrating the internal configuration of a foreign-matter collection apparatus 60 in a second embodiment.

Components of the outboard motor in the second embodiment other than the foreign-matter collection apparatus 60, in particular the outboard-motor main-body 10, the anti-ventilation plate 20, the anti-splash plate 30, and the propeller 40, are similar to those in the first embodiment, and descriptions thereof are omitted herein.

The foreign-matter collection apparatus 60 includes a body case 61, a lid 62, and a filter 63. For example, the foreign-matter collection apparatus 60 may be located above the anti-ventilation plate 20 and affixed to a rear portion of the outboard-motor main-body 10 by, for example, a screw in a detachable manner. For example, two foreign-matter collection apparatuses 60 may be disposed to have left-right symmetry. The following descriptions are given of examples for the left foreign-matter collection apparatus 60.

Also in the second embodiment, the foreign-matter collection apparatus 60 is provided above the anti-ventilation plate 20 and outside the outboard-motor main-body 10 and located at a height such that a water intake 61*a* is submerged under water when a ship to which the outboard-motor main-body 10 has been attached is in a pre-planing state. The second embodiment is also such that the water intake 61*a* is located below the anti-splash plate 30. In the second embodiment, the entirety of the foreign-matter collection apparatus 60 is located below the anti-splash plate 30.

For example, the body case 61 may assume a rectangular hollow shape (an example of a hollow shape) open in the front-rear direction and include a front portion functioning as the water intake 61*a* and a rear portion functioning as a water outlet 61*c*. The water intake 61*a* of the foreign-matter collection apparatus 60 located to the left of the outboard-motor main-body 10 includes an upper edge 61*a*-1 provided with an inclined portion extending rightward to be positioned forward of the left side surface of the body case 60. A lower edge 61*a*-2 is provided rearward of the upper edge 61*a*-1 and includes an inclined portion extending forward right.

The lid 62 is affixed to an upper portion of the body case 61 by, for example, a screw in a detachable manner. The lid 62 covers a removal port (not illustrated) through which the filter 63 is removed. The filter 63 is disposed below the lid 62 and inside the body case 61. For example, the filter 63 may be a sponge filter assuming a rectangular-solid shape. As in the case of the second filter 57*a* described above, assuming, for example, that microplastics visible to the naked eye are included in objects to be collected, the filter 63 may catch foreign matter with a size of about 0.1 to 0.2 mm, which is visible to the naked eye. Microplastics consist of plastic particles having a size of, for example, 5 mm or less, and thus the filter 63 may catch foreign matter with a size of 5 mm or less.

Water taken in through the water intake 61*a* (water flow F11) flows thorough the filter 63 to the water outlet 61*c*. The left and right side surfaces of the body case 61 have provided therein backflow release holes 61*d* and 61*e* shaped like, for example, rectangles and located between the filter 63 and the water outlet 61*c*. The backflow release hole 61*d* provided in the left side surface of the left foreign-matter collection apparatus 60 depicted in FIG. 9 is smaller than the backflow release hole 61*e* provided in the right side surface thereof. Barriers 61*f* and 61*g* are provided inside the body case 61 and respectively located forward of the backflow release holes 61*d* and 61*g*. The barriers 61*f* and 61*g* release, to the backflow release holes 61*d* and 61*e*, backflows F12 and F13 drawn in through the water outlet 61*c* when the outboard motor 1 moves rearward. Note that the barriers 61*f* and 61*g* and the backflow release holes 61*d* and 61*e* are examples of the backflow release section. The barrier 61*f* is located rearward of the barrier 61*g*.

Figure 10:
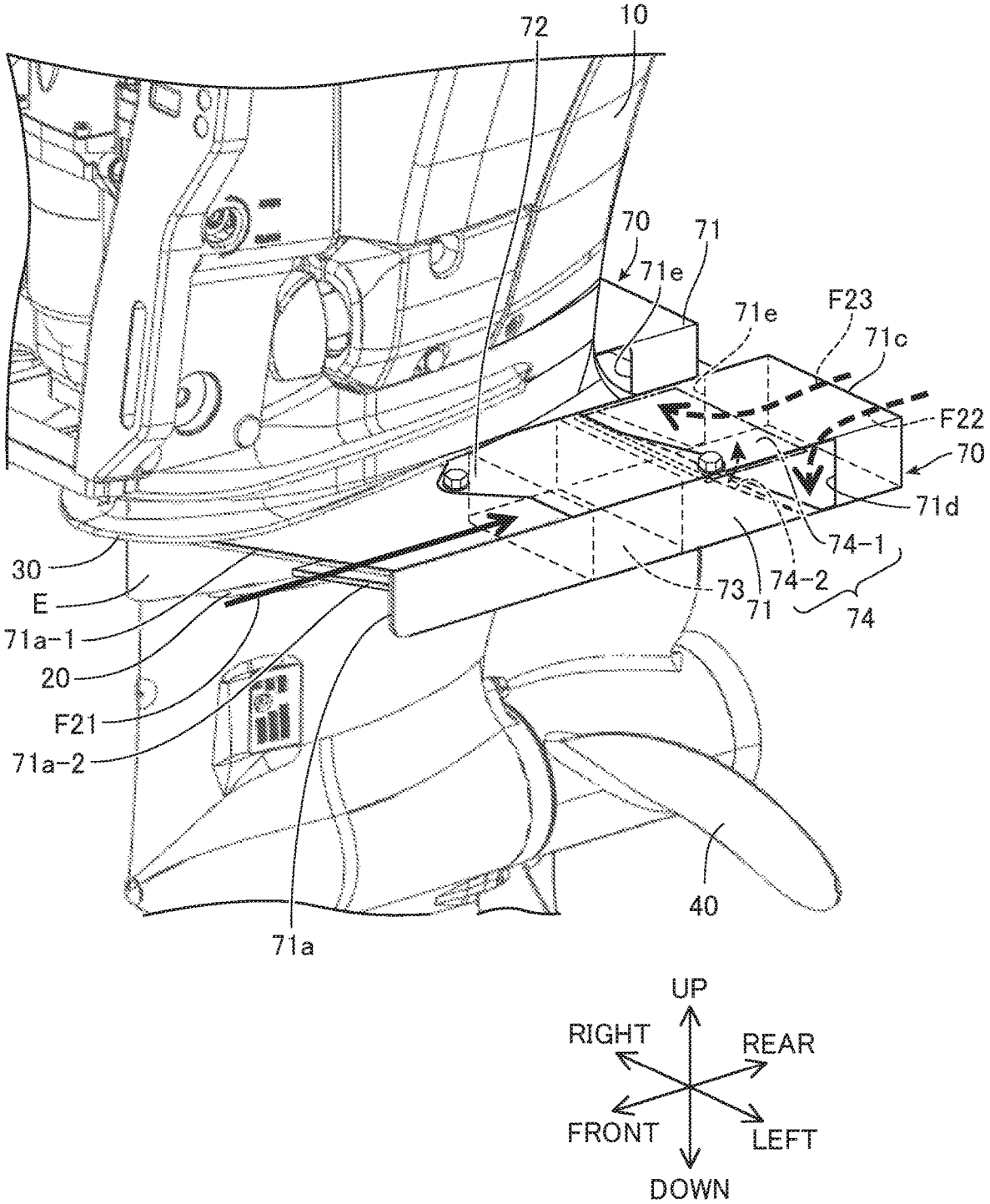
FIG. 10 is a perspective view illustrating the internal configuration of a foreign-matter collection apparatus in a variation of a second embodiment.

FIG. 10 is a perspective view illustrating the internal configuration of a foreign-matter collection apparatus 70 in a variation of the second embodiment.

The foreign-matter collection apparatus 70 and the foreign-matter collection apparatus 60 are different mainly in that the former is provided with an open-close member 74, in place of the barriers 61*f* and 61*g* depicted in FIG. 9; and otherwise these foreign-matter collection apparatuses may be similar. Accordingly, detailed descriptions are omitted herein.

The foreign-matter collection apparatus 70 includes a body case 71, a lid 72, a filter 73, and the open-close member 74. For example, two foreign-matter collection apparatuses 70 may be disposed to have left-right symmetry. The following descriptions are given of examples for the left foreign-matter collection apparatus 70.

The foreign-matter collection apparatus 70 is provided above the anti-ventilation plate 20 and outside the outboard-motor main-body 10 and located at a height such that a water intake 71*a* is submerged under water when a ship to which the outboard-motor main-body 10 has been attached is in a pre-planing state. The entirety of the foreign-matter collection apparatus 70 is located below the anti-splash plate 30.

For example, the body case 71 may assume a rectangular hollow shape (an example of a hollow shape) open in the front-rear direction and include a front portion functioning as the water intake 71*a* and a rear portion functioning as a water outlet 71*c*. The water intake 71*a* of the foreign-matter collection apparatus 70 located to the left of the outboard-motor main-body 10 includes an upper edge 71*a*-1 provided with an inclined portion extending rightward to be positioned forward of the left side surface of the body case 71. A lower edge 71*a*-2 is provided rearward of the upper edge 71*a*-1 and includes an inclined portion extending forward right.

The lid 72 is affixed to an upper portion of the body case 71 by, for example, a screw in a detachable manner. The lid 72 covers a removal port (not illustrated) through which the filter 73 is removed. The filter 73 is disposed below the lid 72 and inside the body case 71. For example, the filter 73 may be a sponge filter assuming a rectangular-solid shape.

Water taken in through the water intake 71*a* (water flow F21) flows thorough the filter 73 to the water outlet 71*c*. The left and right side surfaces of the body case 71 have provided therein backflow release holes 71*d* and 71*e* shaped like, for example, triangles and located between the filter 73 and the water outlet 71*c*. The open-close member 74 is provided inside the body case 71 and located forward of the backflow release holes 71*d* and 71*e*. For example, the open-close member 74 can swing with a hinge that is provided on the inner upper surface of the body case 71 serving as an axis of swinging. The open-close member 74 swings along the inner upper surface of the body case 71 to a position such that the inner passage of the body case 71 opens (see mark 74-1 indicated by two-dot dash lines) and to a position such that the inner passage is closed (see mark 74-2 indicated by dashed lines). For example, a biasing member (e.g., torsional spring) provided on the hinge serving as the axis of swinging may bias the open-close member 74 toward the position such that the inner passage of the body case 71 is closed (mark 74-1). Thus, the open-close member 74 releases, to the backflow release holes 71*d* and 71*e*, backflows F22 and F23 drawn in through the water outlet 71*c* when the outboard motor moves rearward. When the outboard motor moves forward, the open-close member 74 is moved against the biasing force of the biasing member by the water flow F21 to the position such that the inner passage of the body case 71 opens (mark 74-1).

In the second embodiment and the variation thereof described so far, the foreign-matter collection apparatuses 60 and 70 are provided above the anti-ventilation plate 20 and outside the outboard-motor main-body 10, as with the foreign-matter collection apparatus 50 in accordance with the first embodiment. Accordingly, regarding the configurations of the second embodiment and the variation thereof that are similar to those in the first embodiment, similar effects, such as the effect of collecting foreign matter while limiting an increase in travel resistance that could occur when high-speed traveling is performed, can be achieved.

In the second embodiment and the variation thereof, the entireties of the foreign-matter collection apparatuses 60 and 70 are located below the anti-splash plate 30. Hence, when the water surface is located above the anti-ventilation plate 20 (e.g., when low-speed traveling is performed), an increase in travel resistance can be limited more effectively. In addition, the foreign-matter collection apparatuses 60 and 70 have a simple configuration in which the bypass passage P2 is not provided, unlike the foreign-matter collection apparatus 50 depicted in FIG. 2. Hence, the foreign-matter collection apparatuses 60 and 70 are especially useful when, for example, being used for a short time to prevent water contamination in a fishery (fishpond). Remnants of feed and animal feces account for a relatively large proportion of the foreign matter in fisheries, but microplastics could also be included in such foreign matter.

The present invention is not limited to the first or second embodiment described above and can be implemented with various changes made thereto. The invention is not limited to the configurations, control operations, or the like illustrated in the attached drawings and can have changes made thereto, as appropriate, as long as the effect of the invention can be achieved. In addition, the invention can be implemented with changes made thereto, as appropriate, without deviating from the scope of the purpose of the invention.

For example, the foreign-matter collection apparatus 50 has a plurality of filters (the first filter 55, the bypass filter 56, and the filter unit 57) disposed therein, and the foreign-matter collection apparatuses 60 and 70 respectively have filters 63 and 73 disposed therein, i.e., each have a single filter disposed therein. However, the number of filters can be changed, as appropriate. The filters are examples of foreign matter collection parts, and the foreign matter collection parts may be instruments such as strainers.

The foreign-matter collection apparatuses 50, 60, and 70 do not need to be located directly above the anti-ventilation plate 20 as long as these apparatuses are located higher than the anti-ventilation plate 20 in the up-down direction. The water intakes 52*a*, 61*a*, and 71*a* of the foreign-matter collection apparatuses 50, 60, and 70 do not need to be located directly below the anti-splash plate 30 as long as these apparatuses are located lower than the anti-splash plate 30 in the up-down direction. The foreign-matter collection apparatuses 50, 60, and 70 can also be applicable to jet-propulsion outboard motors, wet bikes, and the like.

The water-intake cover 52 of the foreign-matter collection apparatus 50 may be integral with the body case 51. Thus, the body case 51 may be provided with the water intake 52*a*. While the bypass passage P2 of the foreign-matter collection apparatus 50 is branched from a portion of the main passage P1 between the water intake 52*a* and the first filter 55, a bypass passage branded from a portion of the main passage P1 between the first filter 55 and the second filter 57*a* (second passage) may be provided.

INDUSTRIAL APPLICABILITY

The outboard motor of the present invention has, as described above, the effect of allowing foreign matter to be collected while limiting an increase in travel resistance that could occur when high-speed traveling is performed and can be useful as an outboard motor that can be attached to various types of ships. In addition, the outboard motor of the present invention can contribute to improvement of water quality and environmental improvement by collecting foreign matter such as microplastics in the sea, lake, river, fisheries, and the like and can widely spread the rise of the people's awareness of environmental improvement or awareness of coping with environmental problems.

REFERENCE SIGNS LIST

1: Outboard motor

10: Outboard-motor main-body

11: Attachment apparatus
12: Engine cover
20: Anti-ventilation plate
30: Anti-splash plate
40: Propeller
50: Foreign-matter collection apparatus
51: Body case
51*a*: Water outlet
51*b*: Backflow release hole
51*c*: First foreign-matter removal port
51*d*: Internal guide plate
51*e*: Barrier
51*f*: Second foreign-matter removal port
51*g*: Partition wall
51*h*: External guide plate
52: Water-intake cover
52*a*: Water intake
52*a*-1: Upper edge
52*a*-2: Lower edge
53: First lid
54: Second lid
55: First filter
56: Bypass filter
57: Filter unit
57*a*: Second filter
57*b*, 57*c*: Barrier
60: Foreign-matter collection apparatus
61: Body case
61*a*: Water intake
61*a*-1: Upper edge
61*a*-2: Lower edge
61*c*: Water outlet
61*d*, 61*e*: Backflow release hole
61*f*, 61*g*: Barrier
62: Lid
63: Filter
70: Foreign-matter collection apparatus
71: Body case
71*a*: Water intake
71*a*-1: Upper edge
71*a*-2: Lower edge
71*c*: Water outlet
71*d*, 71*e*: Backflow release hole
72: Lid
73: Filter
74: Open-close member
E: Elastic body
F1-F3, F11, F21: Water flow
F4: Foreign-matter flow
F5-F8, F12, F13, F22, F23: Backflow
P1: Main passage (first passage)
P2: Bypass passage (second passage)
P3: Backflow passage

The invention claimed is:

1. An outboard motor comprising:
an outboard-motor main-body;
an anti-ventilation plate provided on the outboard-motor main-body; and
a foreign-matter collection apparatus provided above the anti-ventilation plate and outside the outboard-motor main-body and located at a height such that a water intake is submerged under water when a ship to which the outboard-motor main-body has been attached is in a pre-planing state,
wherein the foreign-matter collection apparatus includes a water outlet and a backflow release section for reducing outflow of foreign matter by releasing a backflow flowing through the water outlet toward the water intake.

2. The outboard motor of claim 1, wherein the foreign-matter collection apparatus further includes a first filter, a second filter including finer pores than the first filter, a first passage extending from the water intake through the first and second filters, and a second passage branched from a portion of the first passage between the water intake and the second filter.

3. The outboard motor of claim 2, wherein the foreign-matter collection apparatus further includes a first foreign-matter removal port for removing foreign matter caught by the first filter and a second foreign-matter removal port for removing foreign matter caught by the second filter.

4. The outboard motor of claim 1, wherein a lower edge of the water intake is provided rearward of an upper edge of the water intake with reference to the outboard motor.

5. The outboard motor of claim 1, further comprising:
an anti-splash plate provided on the outboard-motor main-body,
wherein the water intake is located below the anti-splash plate.

6. The outboard motor of claim 1, further comprising:
an elastic body located between the foreign-matter collection apparatus and the outboard-motor main-body.

7. An outboard motor comprising:
an outboard-motor main-body;
an anti-ventilation plate provided on the outboard-motor main-body; and
a foreign-matter collection apparatus provided above the anti-ventilation plate and outside the outboard-motor main-body and located at a height such that a water intake is submerged under water when a ship to which the outboard-motor main-body has been attached is in a pre-planing state,
wherein the foreign-matter collection apparatus includes a first filter, a second filter including finer pores than the first filter, a first passage extending from the water intake through the first and second filters, and a second passage branched from a portion of the first passage between the water intake and the second filter.

8. The outboard motor of claim 7, wherein the foreign-matter collection apparatus further includes a first foreign-matter removal port for removing foreign matter caught by the first filter and a second foreign-matter removal port for removing foreign matter caught by the second filter.

9. The outboard motor of claim 7, wherein a lower edge of the water intake is provided rearward of an upper edge of the water intake with reference to the outboard motor.

10. The outboard motor of claim 7, further comprising:
an anti-splash plate provided on the outboard-motor main-body,
wherein the water intake is located below the anti-splash plate.

11. The outboard motor of claim 7, further comprising:
an elastic body located between the foreign-matter collection apparatus and the outboard-motor main-body.

* * * * *